US007348972B2

(12) United States Patent
Ushigusa

(10) Patent No.: US 7,348,972 B2
(45) Date of Patent: Mar. 25, 2008

(54) DISPLAY PANEL DRIVING APPARATUS HAVING EFFICIENT OSCILLATORS

(75) Inventor: Yoshihiro Ushigusa, Sagamihara (JP)

(73) Assignee: Samsung SDI Co., Ltd., Suwon (KR)

( * ) Notice: Subject to any disclaimer, the term of this patent is extended or adjusted under 35 U.S.C. 154(b) by 673 days.

(21) Appl. No.: 10/834,252

(22) Filed: Apr. 29, 2004

(65) Prior Publication Data

US 2004/0217927 A1 Nov. 4, 2004

(30) Foreign Application Priority Data

May 1, 2003 (KR) ..... 10-2003-0027989

(51) Int. Cl.
*G09G 5/40* (2006.01)
*G09G 5/00* (2006.01)
*G09G 3/30* (2006.01)

(52) U.S. Cl. ..... 345/214; 345/76; 345/204; 345/211; 349/142; 349/143

(58) Field of Classification Search ..... 345/33, 345/76, 204, 211, 214; 349/68, 127, 128, 349/131, 139, 143, 142
See application file for complete search history.

(56) References Cited

U.S. PATENT DOCUMENTS 4,764,766 A * 8/1988 Aoyama et al. ..... 345/103
5,877,733 A 3/1999 Uchida et al.
5,903,327 A * 5/1999 Hijii ..... 349/73
6,005,537 A * 12/1999 Yokota et al. ..... 345/33
6,236,443 B1 * 5/2001 Carlsen ..... 349/143
6,259,421 B1 * 7/2001 Yokota et al. ..... 345/33
6,396,464 B2 * 5/2002 Yokota et al. ..... 345/33

FOREIGN PATENT DOCUMENTS

CN 1405749 3/2003

* cited by examiner

*Primary Examiner*—Richard Hjerpe
*Assistant Examiner*—My-Chau T. Tran
(74) *Attorney, Agent, or Firm*—H.C. Park & Associates, PLC

(57) ABSTRACT

Provided is an apparatus for driving a display panel. The apparatus includes a main display control unit, an icon display control unit, a dot-matrix display control unit, first and second oscillators, an icon driver, and a dot-matrix driver. While the first oscillator generates a first clock signal composed of pulses having a first frequency and supplies the same to the dot-matrix display control unit, the second oscillator generates a second clock signal composed of pulses having a second frequency that is lower than the first frequency and supplies the second clock signal to the icon display control unit.

2 Claims, 2 Drawing Sheets

DISPLAY PANEL DRIVING APPARATUS HAVING EFFICIENT OSCILLATORS

CROSS-REFERENCE TO RELATED APPLICATION

This application claims the priority of Korean Patent Application No. 2003-27989, filed on May 1, 2003, in the Korean Intellectual Property Office, the disclosure of which is incorporated herein by reference in its entirety.

1. Field of the Invention

The present invention relates to a display panel such as an electro-luminescence (EL) display panel, and more particularly, to an apparatus for driving a display panel divided into an icon area to display predetermined icons according to input icon data and a dot-matrix area to display varying images according to input dot-matrix data.

2. Background of the Invention

Referring to FIG. 1, a conventional display panel 3, for example, an electro-luminescence (EL) display panel used for a portable cellular phone, includes an icon area 31 and a dot-matrix area 32. The icon area 31 has irregularly shaped display cells to display icons having predetermined shapes while the dot-matrix area 32 has regularly shaped display cells to display variable images.

A typical apparatus for driving the display panel 3 comprises a display controller 1, an icon driver 21, a dot-matrix driver 22, and a DC-to-DC (DC-DC) converter 4. The display controller 1 comprises a main display control unit 11, an icon display control unit 12, a dot-matrix display control unit 13, an oscillator 14, and a memory 15. The display controller 1 is operated by an input DC voltage $V_{DD}$ slightly adjusted from a battery voltage $V_{BA}$ The main display control unit 11 divides input image data $D_{IM}$ into icon data $D_{IC}$ and dot-matrix data $D_{DM}$ and outputs the icon data $D_{IC}$ and dot-matrix data $D_{DM}$. The icon display control unit 12 processes the icon data $D_{IC}$ received from the main display control unit 11 according to an arrangement within the icon area 31 of the display panel 3 and outputs separate icon data $D_{ICD}$ and timing control signals $D_{ICC}$ simultaneously. The dot-matrix display control unit 13 processes the dot-matrix data $D_{DM}$ received from the main display control unit 11 according to an arrangement within the dot-matrix area 32 and outputs separate dot-matrix data $D_{DMD}$ and timing control signals $D_{DMC}$ simultaneously. Here, the dot-matrix data $D_{DM}$ received from the main display control unit 11, including the separate dot-matrix data $D_{DMD}$, is stored in the memory 15 by the dot-matrix display control unit 13. The separate dot-matrix data $D_{DMD}$ stored in the memory 15 is read and output by the dot-matrix display control unit 13 according to the timing control signals $D_{DMC}$ output from the dot-matrix control unit 13. The oscillator 14 generates a clock signal CLK1 composed of pulses having a predetermined frequency and supplies the same to the icon and dot-matrix display control units 12 and 13.

The icon driver 21 generates icon drive signals $S_{IC}$ in response to the separate icon data $D_{ICD}$ and timing control signals $D_{ICC}$ received from the icon display control unit 12, and drives the icon area 31 in the display panel 3. The dot-matrix driver 22 generates dot-matrix drive signals $S_{DM}$ in response to the separate dot-matrix data $D_{DMD}$ and timing control signals $D_{DMC}$ received from the dot-matrix display control unit 13, and drives the dot-matrix area 32 in the display panel 3. The DC-DC converter 4 steps up the battery voltage $V_{BA}$ as the input DC voltage via a coil and supplies a stepped-up boost voltage V1 to the dot-matrix driver 22 and the icon driver 21.

In the display controller 1, the frequency of the clock signal required for the icon display control unit 12 is significantly lower than that required for the dot-matrix display control unit 13. Despite this fact, in the conventional driving apparatus configured as above, the high frequency clock signal CLK1 is supplied from the single oscillator 14 to the icon display control unit 12 and the dot-matrix display control unit 13. Thus, the conventional driving apparatus has a problem in that power consumption may be unnecessarily high. This has become a stringent problem in display applications, such as cellular phones, in which the icon display control unit 12 always operates to display the icon area 31 and causes inconvenience to users due to frequent battery charging.

SUMMARY OF THE INVENTION

The present invention provides an apparatus for driving a display panel having an icon area and a dot-matrix area, designed to reduce power consumption for a user's convenience by maximizing the efficiency of driving power.

According to an aspect of the present invention, there is provided an apparatus for driving a display panel, including an icon area displaying predetermined icons according to input icon data and a dot-matrix area displaying varying images depending on input dot-matrix data. The apparatus comprises a main display control unit, an icon display control unit, first and second oscillators, an icon driver, and a dot-matrix driver.

The main display control unit divides input image data into the icon data and the dot-matrix data and outputs the icon data and the dot-matrix data. The icon display control unit processes the icon data received from the main display control unit in accordance with an arrangement within the icon area of the display panel and simultaneously outputs separate icon data and timing control signals. The dot-matrix display control unit processes the dot-matrix data received from the main display control unit according to an arrangement within the dot-matrix area and outputs separate dot-matrix data and timing control signals simultaneously. The first oscillator generates a first clock signal composed of pulses having a first frequency and supplies the same to the dot-matrix display control unit. The second oscillator generates a second clock signal composed of pulses having a second frequency that is lower than the first frequency. The second oscillator supplies the second clock signal to the icon display control unit. The icon driver drives the icon area of the display panel in response to the separate icon data and timing control signals received from the icon display control unit. The dot-matrix driver drives the dot-matrix area of the display panel in response to the separate dot-matrix data and timing control signals received from the dot-matrix display control unit.

In the apparatus for driving a display panel, the first clock signal composed of pulses having the first frequency is supplied to the dot-matrix display control unit by the first oscillator. The second clock signal composed of pulses having the second frequency that is lower than the first frequency is supplied to the icon display control unit by the second oscillator. Thus, it is possible to maximize the efficiency of the driving power, which reduces power consumption in a large range of display applications. This is because the frequency of the clock signal required for the icon display control unit is lower than that required for the dot-matrix display control unit. This advantage may be important for display applications, such as cellular phones requiring the icon area to be displayed always, and extends the battery life by reducing the number of battery charging operations.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
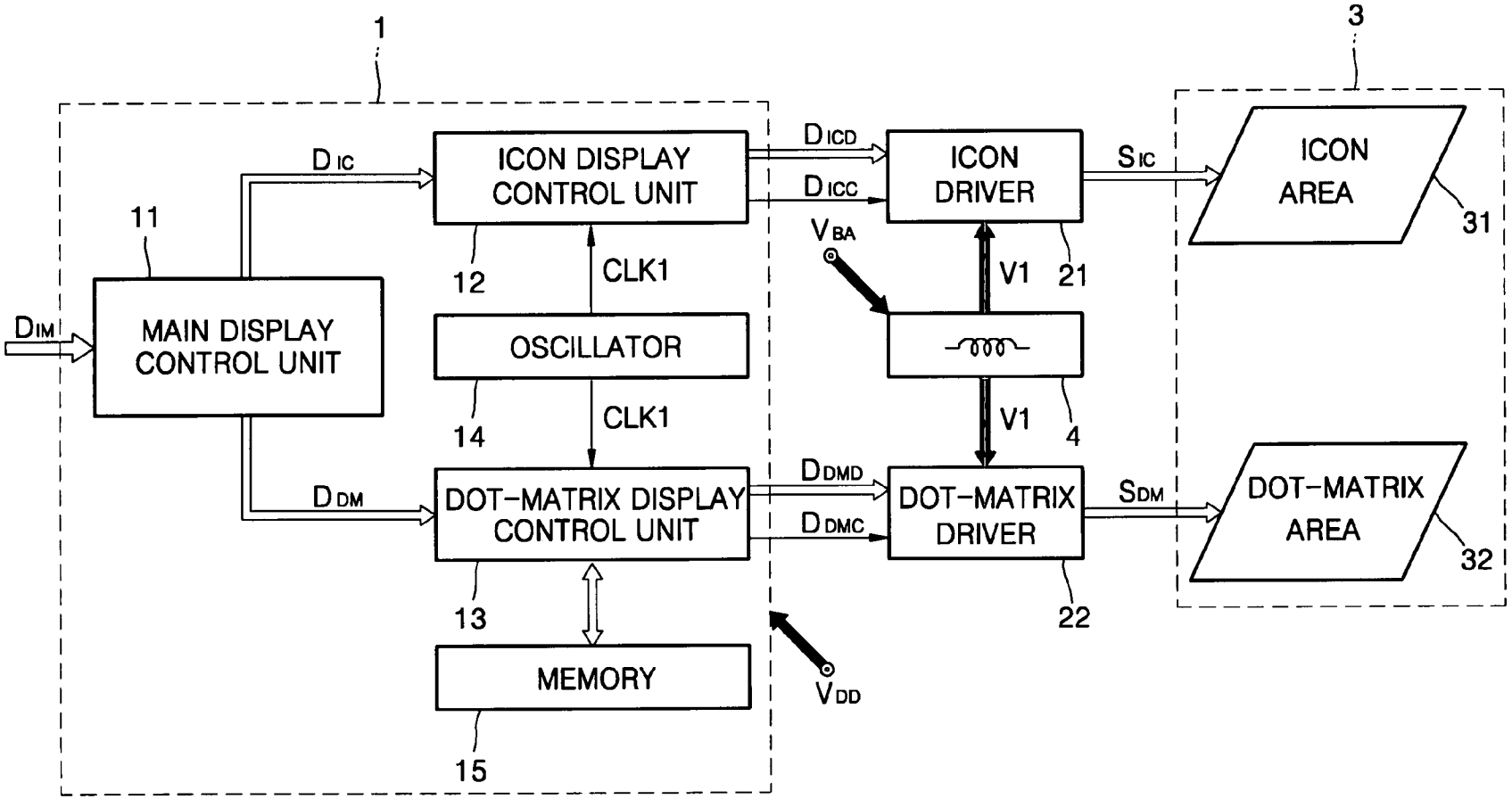
FIG. 1 (PRIOR ART)
FIG. 1 shows a conventional apparatus for driving a display panel.
Figure 2:
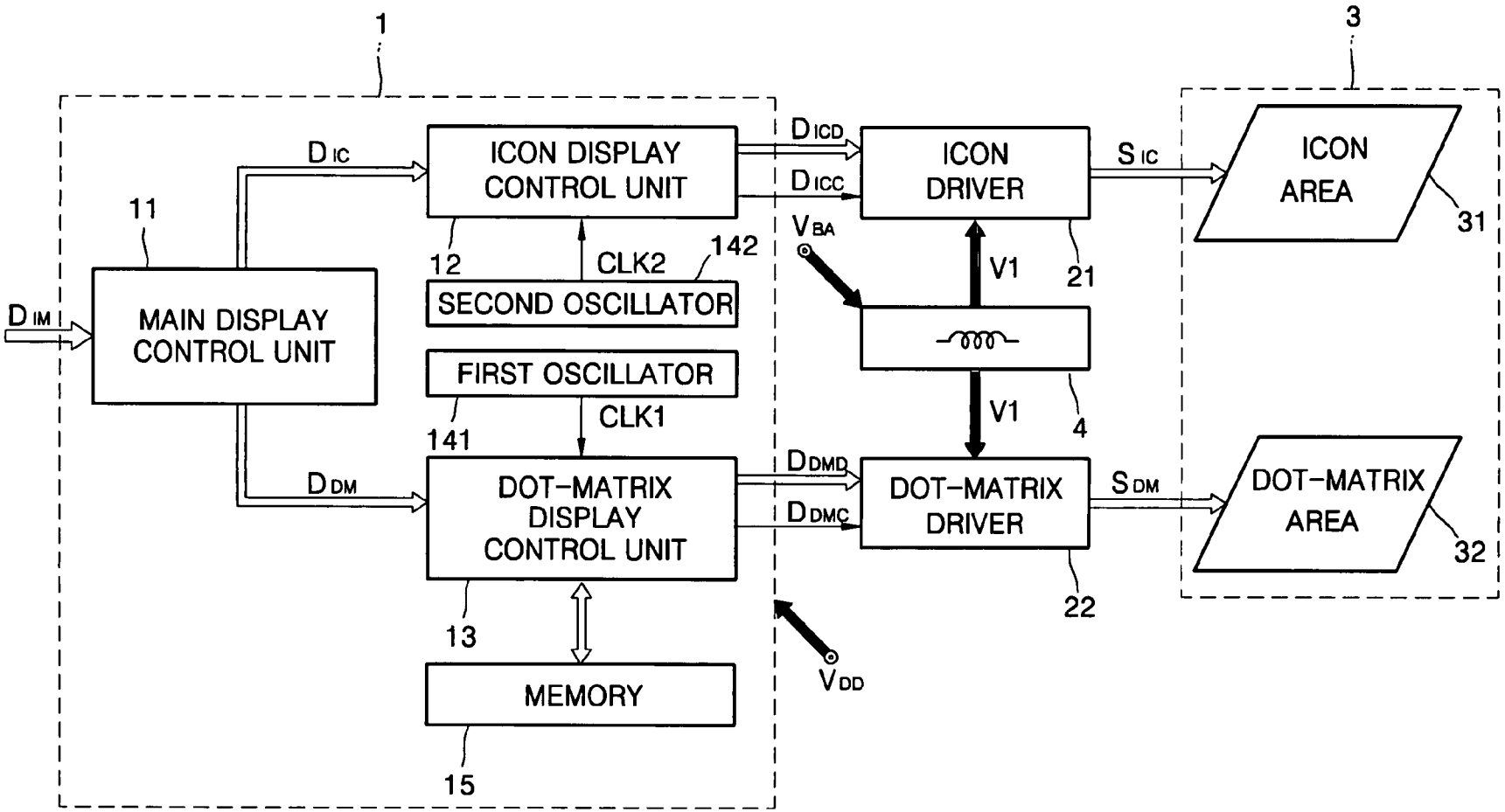
FIG. 2 shows an apparatus for driving a display panel according to an embodiment of the present invention.

Referring to FIG. 2, a display panel 3 to be driven by an apparatus of the invention, for example, an electro-luminescence (EL) display panel used in a portable cellular phone, includes an icon area 31 and a dot-matrix area 32. The icon area 31 has irregularly shaped display cells to display icons having predetermined shapes while the dot-matrix area 32 has uniformly shaped and regularly arranged display cells to display variable images.

The apparatus for driving the display panel 3 includes a display controller 1, an icon driver 21, a dot-matrix driver 22, and a DC-to-DC (DC-DC) converter 4. The display controller 1 includes a main display control unit 11, an icon display control unit 12, a dot-matrix display control unit 13, a first oscillator 141, a second oscillator 142, and a memory 15. The display controller 1 is operated by an input DC voltage $V_{DD}$ slightly adjusted from a battery voltage $V_{BA}$.

The main display control unit 11 divides input image data $D_{IM}$ into icon data $D_{IC}$ and dot-matrix data $D_{DM}$ and outputs the icon data $D_{IC}$ and the dot-matrix data $D_{DM}$. The icon display control unit 12 processes the icon data $D_{IC}$ received from the main display control unit 11 in accordance with an arrangement within the icon area 31 of the display panel 3 and outputs separate icon data $D_{ICD}$ and timing control signals $D_{ICC}$ at the same time. The dot-matrix display control unit 13 processes the dot-matrix data $D_{DM}$ received from the main display control unit 11 according to an arrangement within the dot-matrix area 32 and outputs separate dot-matrix data $D_{DMD}$ and timing control signals $D_{DMC}$ at the same time. Here, the dot-matrix data $D_{DM}$, including the separate dot-matrix $D_{DMD}$, received from the main display control unit 11 is stored in the memory 15 by the dot-matrix display control unit 13. The separate dot-matrix data $D_{DMD}$ stored in the memory 15 is read and output by the dot-matrix display control unit 13 according to the timing control signals $D_{DMC}$ output from the dot-matrix control unit 13.

Meanwhile, the first oscillator 141 of the display controller 1 generates a first clock signal CLK1 composed of pulses having a first frequency and supplies the same to the dot-matrix display control unit 13. The second oscillator 142 generates a second clock signal CLK2 composed of pulses having a second frequency and supplies the same to the icon display control unit 12. Thus, it is possible to maximize the efficiency of driving power thus reducing power consumption in the apparatus. This is because the second frequency of second clock signal CLK2 required for the icon display control unit 12 is lower than the first frequency of first clock signal CLK1 required for the dot-matrix display control unit 13.

The icon driver 21 generates icon drive signals $S_{IC}$ in response to the separate icon data $D_{ICD}$ and timing control signals $D_{ICC}$ received from the icon display control unit 12 and drives the icon area 31 in the display panel 3. The dot-matrix driver 22 generates dot-matrix drive signals $S_{DM}$ in response to the separate dot-matrix data $D_{DMD}$ and timing control signals $D_{DMC}$ received from the dot-matrix display control unit 13 and drives the dot-matrix area 32 in the display panel 3. The DC-DC converter 4 steps up the battery voltage $V_{BA}$ as the input DC voltage via a coil and supplies a stepped-up boost voltage V1 to the dot-matrix driver 22 and the icon driver 21.

As described above, in the apparatus for driving a display panel according to the invention, the first oscillator 141 supplies the first clock signal CLK1, composed of pulses having the first frequency, to the dot-matrix display control unit 13. The second oscillator 142 supplies the second clock signal CLK2, composed of pulses having the second frequency, to the icon display control unit 12. Thus, it is possible to maximize the efficiency of driving power thereby reducing power consumption in the apparatus. This is because the second frequency required for the icon display control unit 12 is lower than the first frequency required for the dot-matrix display control unit 13. The above advantage is important for display applications, such as cellular phones, requiring the icon area 31 to be always displayed and provides user convenience by reducing the number of battery charging operations.

An example of the configuration of a display panel to which this invention relates is disclosed in detail in U.S. Pat. No. 6,236,443, the contents of which are incorporated herein by reference in its entirety.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for driving a display panel including an icon area to display predetermined icons according to icon data for display and a dot-matrix area to display varying images according to dot-matrix data, the apparatus comprising:

a main display control unit that divides input image data into the icon data and the dot-matrix data and outputs the icon data and the dot-matrix data;

an icon display control unit that processes the icon data received from the main display control unit in accordance with an arrangement within the icon area of the display panel and simultaneously outputs separate icon data and timing control signals;

a dot-matrix display control unit that processes the dot-matrix data received from the main display control unit according to an arrangement within the dot-matrix area and outputs separate dot-matrix data and timing control signals simultaneously;

a first oscillator that generates a first clock signal composed of pulses having a first frequency and supplies the first clock signal to the dot-matrix display control unit;

a second oscillator generates a second clock signal composed of pulses having a second frequency that is lower than the first frequency and supplies the second clock signal to the icon display control unit;

an icon driver that drives the icon area of the display panel in response to the separate icon data and timing control signals received from the icon display control unit; and a dot-matrix driver that drives the dot-matrix area of the display panel in response to the separate dot-matrix data and timing control signals received from the dot-matrix display control unit.

2. The apparatus of claim 1, further comprising a memory, wherein the dot-matrix data, including the separate dot-matrix data, received from the main display control unit is stored in the memory by the dot-matrix display control unit, and the separate dot-matrix data stored in the memory is read and output by the dot-matrix display control unit according to the timing control signals output from the dot-matrix control unit.

* * * * *